US005163751A

United States Patent [19]

Bottiglieri

[11] Patent Number: 5,163,751

[45] Date of Patent: Nov. 17, 1992

[54] TROUBLE LIGHT POSITIONER

[76] Inventor: Peter Bottiglieri, 20841 Stoney Ave., Maple Ridge, British Columbia, Canada, V2X 7T2

[21] Appl. No.: 871,085

[22] Filed: Apr. 20, 1992

[51] Int. Cl.[5] ..... F21V 15/00

[52] U.S. Cl. ..... 362/376; 362/396

[58] Field of Search ..... 362/376, 377, 396

[56] References Cited

U.S. PATENT DOCUMENTS

| | | |
|---|---|---|
| 365,158 | 6/1887 | Duzer . |
| 562,949 | 6/1896 | Casler . |
| 1,932,697 | 10/1933 | Jankovic . |
| 2,460,173 | 1/1949 | Halbing . |
| 3,474,244 | 10/1969 | Hanlon . |
| 3,809,883 | 5/1974 | Goodwin . |
| 3,814,927 | 6/1974 | Buzza . |
| 4,272,803 | 6/1981 | Johnson . |
| 4,298,922 | 11/1981 | Hardwick . |
| 4,305,120 | 12/1981 | Lacinski . |
| 4,321,660 | 3/1982 | Sokol . |
| 4,369,487 | 1/1983 | Carlow . |
| 4,581,688 | 4/1986 | Trygar . |
| 4,594,647 | 6/1986 | Dippert . |
| 4,639,842 | 1/1987 | Upchurch . |
| 4,644,456 | 2/1987 | Lydell . |
| 4,676,465 | 6/1987 | Myotte . |
| 4,848,818 | 7/1989 | Smith . |

*Primary Examiner*—Carroll B. Dority
*Attorney, Agent, or Firm*—Barrigar & Oyen

[57] ABSTRACT

A trouble light positioner having first and second hooks, a swivel for swivelably mounting the first hook atop a trouble light, a mechanism for retaining the swivel in a selected position, and a mechanism for slidably attaching the second hook to the trouble light's power cord.

6 Claims, 3 Drawing Sheets

TROUBLE LIGHT POSITIONER

FIELD OF THE INVENTION

This application pertains to a device for positioning a trouble light in a selected position.

BACKGROUND OF THE INVENTION

Trouble lights are used by workmen to illuminate work spaces such as engine compartments, vehicle undercarriages, furnace rooms, attics, etc. which are difficult to illuminate adequately with workshop ceiling lights. In a typical trouble light, a light bulb is enclosed within a protective metal cage. The light bulb and cage are mounted atop a handle. A power cord extends from the base of the handle. A hook mounted atop the cage is used to hang the trouble light at a convenient spot so that the bulb will illuminate a desired portion of the work space. A trouble light must be sufficiently rugged to withstand dirty work environments, plus a good deal of jarring, dropping and knocking about.

The prior art has evolved a variety of trouble light positioning mechanisms which improve the workman's ability to direct the light to a desired portion of the work space. The present invention further improves upon this important aspect of the operation of a trouble light.

SUMMARY OF THE INVENTION

In accordance with the preferred embodiment, the invention provides a trouble light positioner having first and second hooks, a swivel for swivelably mounting the first hook atop a trouble light, a mechanism for retaining the swivel in a selected position, and a mechanism for slidably attaching the second hook to the trouble light's power cord. A second retaining mechanism may be provided to releasably retain the second hook within the base of the trouble light.

Preferably, the swivel comprises first and second washers having opposed serrated surfaces. The first washer is fixed to the first hook. The second washer rotates around the first hook, with respect to the first washer.

The retention mechanism may comprise a spring mounted on the first hook to urge the second washer against the first washer. A pawl nut mounted on the first hook compresses the spring against the second washer. An annular groove on the first hook preventing the pawl nut from slipping away from the spring.

DETAILED DESCRIPTION OF THE PREFERRED EMBODIMENT

Figure 1:
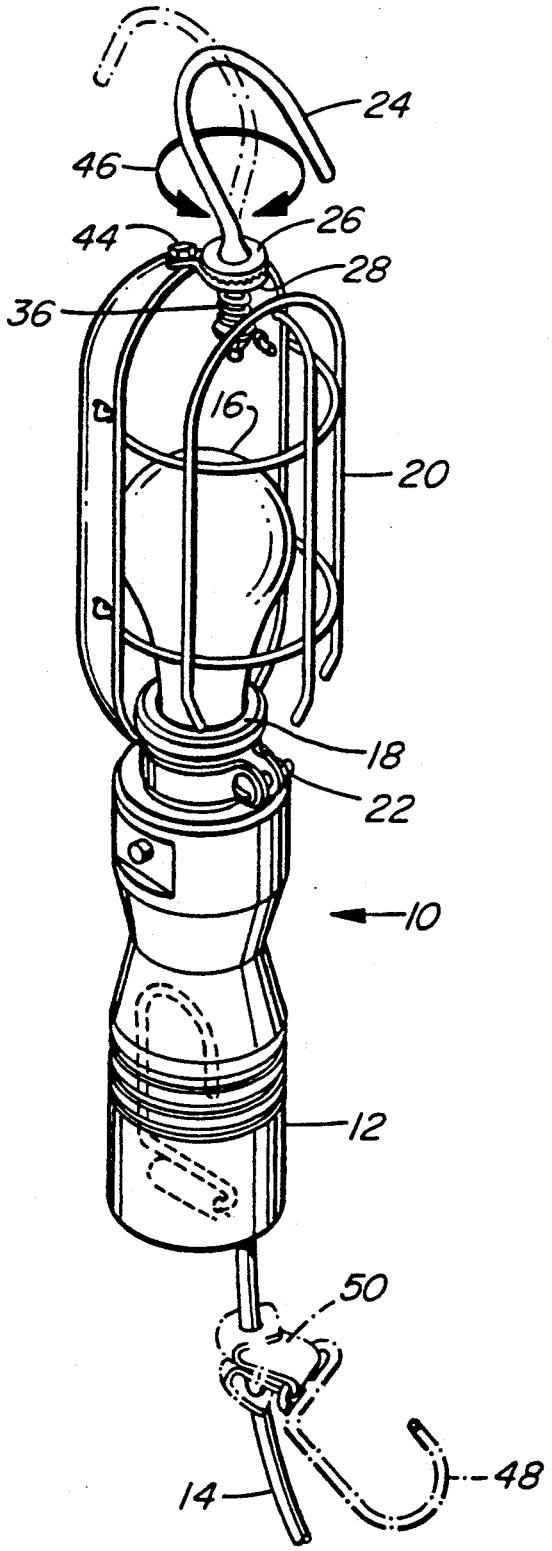
FIG. 1 is a pictorial illustration of a trouble light equipped with a trouble light positioner constructed in accordance with the preferred embodiment of the invention.

FIG. 1 depicts a conventional trouble light 10 having a handle 12 from which an electrical power cord 14 extends. A light bulb 16 is removably screwed into a socket 18 provided atop handle 12. A metal cage 20 fastened atop handle 12 by clamp 22 surrounds and protects light bulb 16. The cage can be opened for replacement of the light bulb.

Figure 2:
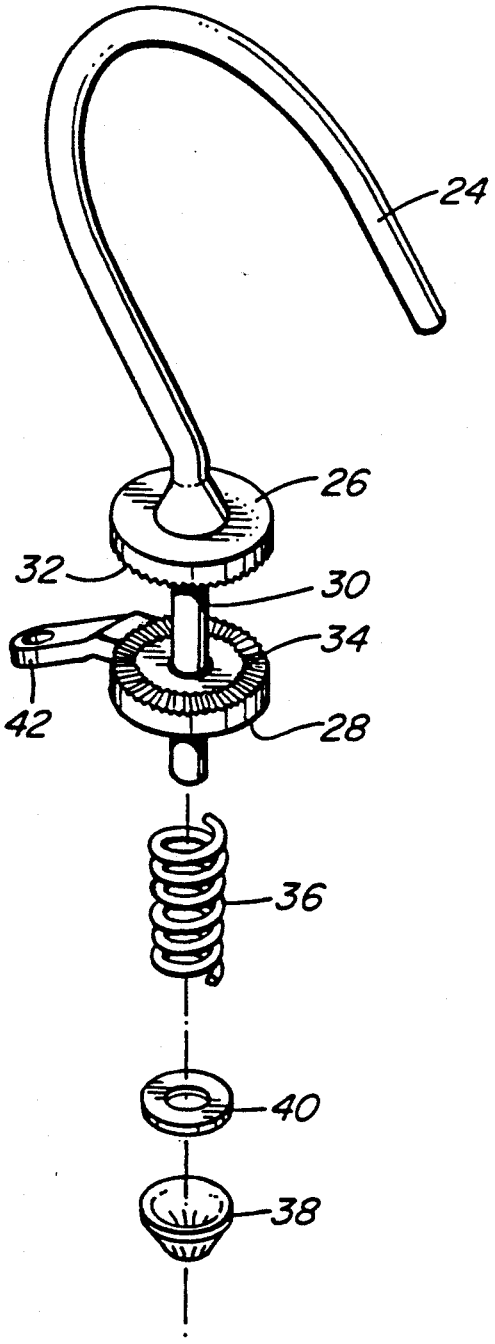
FIG. 2 is an enlarged, exploded illustration of the swivel mechanism of the preferred embodiment.

As shown in FIGS. 1 and 2, a first hook 24 is swivelably mounted atop cage 20 by a "swivel means" consisting of first and second washers 26, 28. First washer 26 is fixed to shank 30 of first hook 24. Shank 30 passes through an aperture in second washer 28, such that second washer 28 can rotate around shank 30 with respect to first washer 26. Washers 26, 28 have opposed serrated surfaces 32, 34.

A "retention means", namely spring 36, is provided for retaining the swivel means in a selected position. Spring 36 slides over shank 30 and is held in place by pawl nut 38, which firmly grips shank 30. Pawl nut 38 is slidably advanced along shank 30 to compress spring 36 between a third washer 40 and the base of second washer 28, thus urging second washer 28 against first washer 26.

Pawl nut 38 is slidably positioned on shank 30 such that washers 26, 28 may rotate relative to one another when a slight twisting force is applied therebetween, but such that serrated surfaces 32, 34 are pressed together to resist further rotation of washers 26, 28 in the absence of such twisting. An annular groove may be cut in shank 30 to receive the lower rim of pawl nut 38, thus assisting in holding pawl nut 38 in position on shank 30 and preventing slippage of pawl nut 38 away from spring 36.

An apertured mounting tab 42 is provided on second washer 28 to facilitate removable affixation of the swivel means atop cage 20 by a screw or bolt 44. Trouble light 10 can then be suspended by hanging first hook 24 over a convenient projection. The workman may then twist handle 20 with one hand to rotate trouble light 10 as aforesaid about its longitudinal axis (i.e. in either direction indicated by double headed arrow 46) to focus the illumination of light bulb 16 on a selected work space.

Suspension of trouble light 10 from a single point may not always enable the workman to optimally illuminate the desired portion of the work space. The invention accordingly provides a second hook 48 and an "attaching means" for slidably attaching second hook 48 to power cord 14. More particularly, second hook 48 is fixed to a short leather strap 50 which is folded several times. A series of aligned apertures are drilled through the folded strap. Power cord 14 is then passed through the aligned apertures. Strap 50 may then be slidably moved along power cord 14, but will resist such movement unless a reasonable sliding force is applied. This facilitates positioning of second hook 48 at any point along power cord 14.

Figure 5:
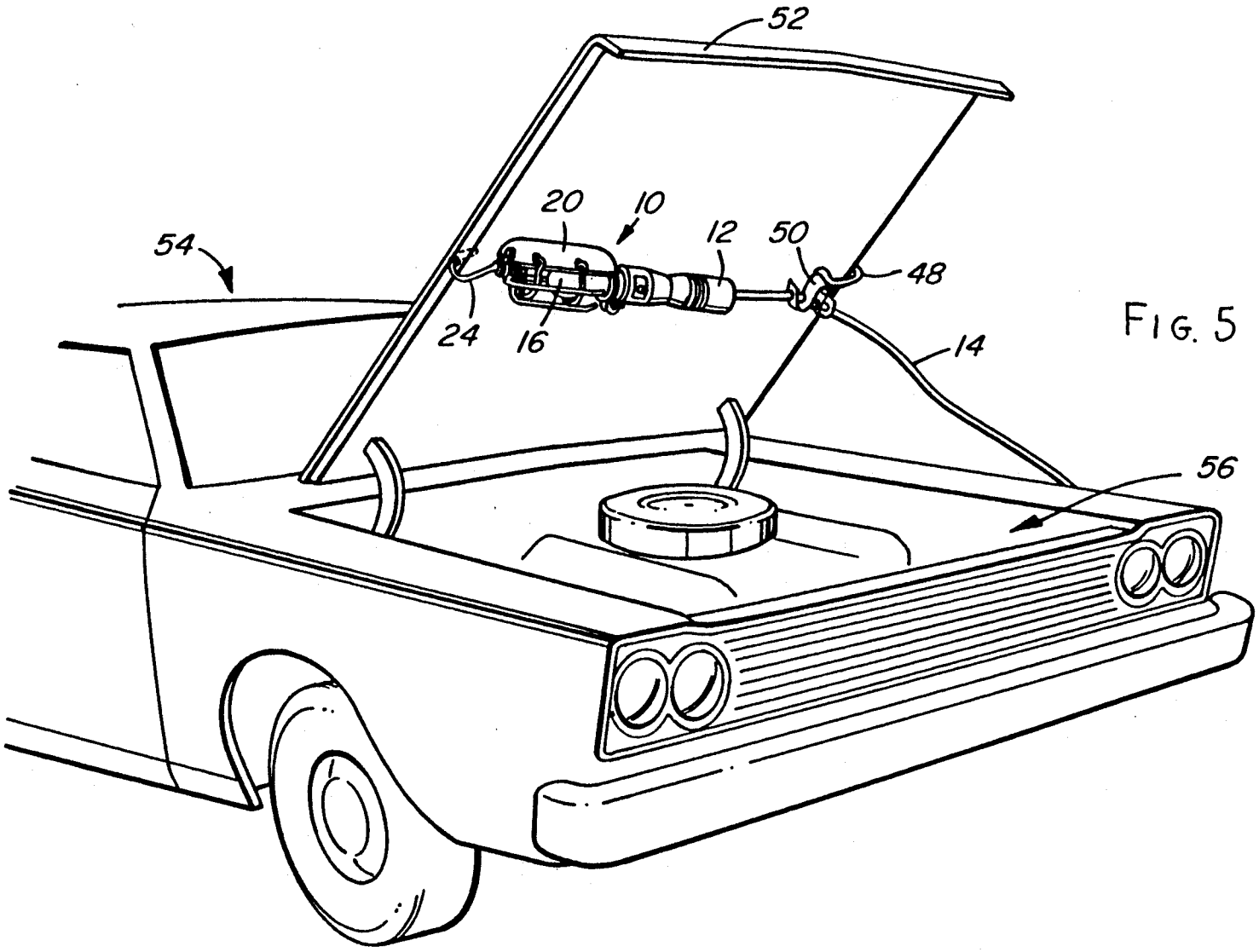
FIG. 5 is a pictorial illustration of a vehicle, showing a trouble light positioned with the aid of the invention to illuminate the vehicle's engine compartment.

First and second hooks 24, 48 may be cooperatively utilized to position trouble light 10 for optimal illumination of a desired portion of the work space. For example, as shown in FIG. 5, first hook 24 may be placed over one edge of the hood 52 of a vehicle 54. Strap 50 is then drawn along power cord 14 until second hook 48 may be fitted over the opposite edge of hood 52, thus suspending trouble light 10 directly above engine compartment 56 so that light from bulb 16 projects directly downwardly into engine compartment 56 for maximum illumination thereof.

Figure 3:
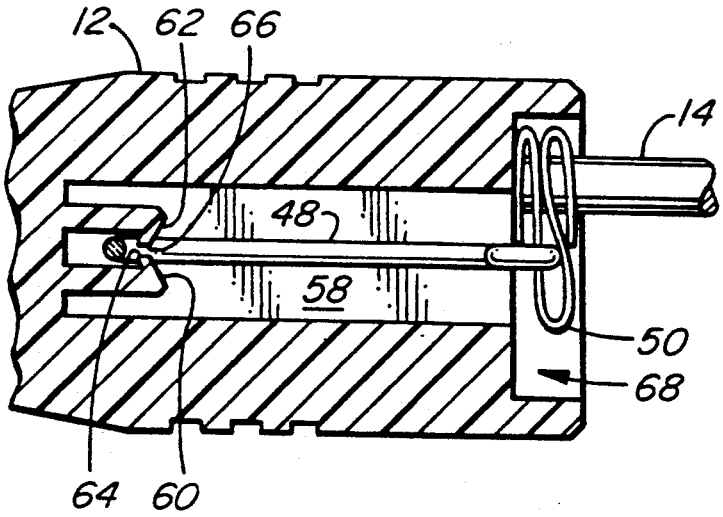
FIG. 3 is an enlarged illustration of the base portion of the trouble light of FIG. 1, sectioned transversely to show a hook-retaining slot provided in the base portion.
Figure 4:
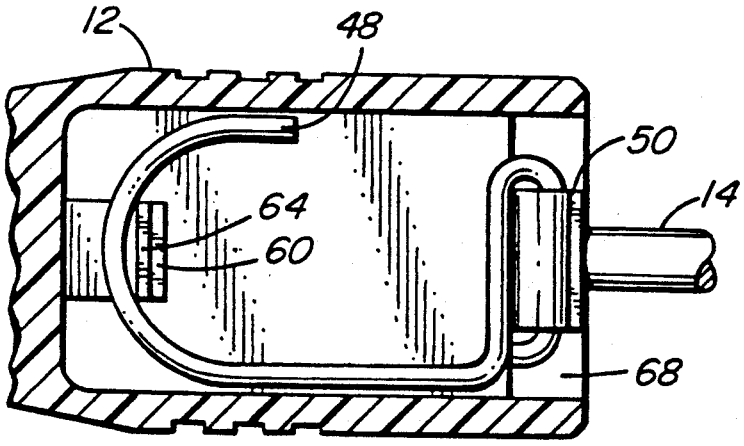
FIG. 4 is similar to FIG. 3, but shows the base portion sectioned parallel to the hook-retaining slot.

As shown in FIGS. 3 and 4, a second "retention means" incorporating slot 58 is provided in the base of handle 12 for releasably retaining second hook 48 within handle 12 when second hook 48 is not in use. In particular, a pair of spaced, plastic spring-like fingers 60, 62 are formed in handle 12, inside slot 58. Lower, inwardly facing projections 64, 66 on fingers 60, 62 are spread apart when second hook 48 is pushed upwardly into slot 58. Fingers 60, 62 spring back into position after second hook 48 has passed above projections 64, 66. Projections 64, 66 prevent second hook 48 being withdrawn from handle 12 unless second hook 48 is intentionally pulled so as to overcome the retention force of spring-like fingers 60, 62. A cavity 68 in the bottom of handle 48 receives strap 50 while second hook 48 is retained as aforesaid within handle 12.

It can thus be seen that the invention does not detract from the desired rugged characteristic of a trouble light; leaves the trouble light free of unnecessary obstructions; and, enhances the workman's ability to illuminate the work space. The positioning mechanism depicted in FIG. 2 allows the workman to reliably, rotatably fix the position of the light throughout a complete 360° range with a one-handed twisting action. The mechanism holds that position irrespective of counter-rotation forces such as those which may be imposed by kinks or twists in power cord 14. The addition of second hook 48 extends the positioning range to include non-vertical and even horizontal orientations of the trouble light.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A trouble light positioner, comprising:

(a) a first hook;

(b) swivel means for swivelably mounting said first hook atop said trouble light;

(c) retention means for retaining said swivel means in a selected position;

(d) a second hook; and, (e) attaching means for slidably attaching said second hook to a power cord extending from said trouble light.

2. A trouble light positioner as defined in claim 1, wherein said swivel means comprises first and second washers having opposed serrated surfaces, said first washer being fixed to said first hook and said second washer being rotatable with respect to said first washer.

3. A trouble light positioner as defined in claim 2, wherein said retention means comprises a spring mounted on said first hook to urge said second washer against said first washer.

4. A trouble light positioner as defined in claim 3, wherein said retention means further comprises a pawl nut mounted on said first hook to compress said spring between said pawl nut and said second washer.

5. A trouble light positioner as defined in claim 4, further comprising an annular groove on said first hook for preventing slippage of said pawl nut away from said spring.

6. A trouble light positioner as defined in claim 1, further comprising retention means for releasably retaining said second hook within a base portion of said trouble light.

* * * * *